US010654278B2

(12) United States Patent
Kashimoto

(10) Patent No.: US 10,654,278 B2
(45) Date of Patent: May 19, 2020

(54) INKJET RECORDING APPARATUS

(71) Applicant: KYOCERA Document Solutions Inc., Osaka (JP)

(72) Inventor: Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/281,818

(22) Filed: Feb. 21, 2019

(65) Prior Publication Data

US 2019/0299621 A1 Oct. 3, 2019

(30) Foreign Application Priority Data

Mar. 28, 2018 (JP) ..... 2018-061458

(51) Int. Cl.
*B41J 2/175* (2006.01)
*B41J 2/18* (2006.01)
*B41J 2/165* (2006.01)

(52) U.S. Cl.
CPC ..... *B41J 2/175* (2013.01); *B41J 2/165* (2013.01); *B41J 2/18* (2013.01)

(58) Field of Classification Search
CPC ..... B41J 2/175; B41J 2/165; B41J 2/18
USPC ..... 347/89
See application file for complete search history.

(56) References Cited

U.S. PATENT DOCUMENTS

2001/0017642 A1* 8/2001 Shigemura ..... B41J 2/175 347/85

FOREIGN PATENT DOCUMENTS

JP 2015-205418 A 11/2015

* cited by examiner

*Primary Examiner* — Huan H Tran
*Assistant Examiner* — Alexander D Shenderov
(74) *Attorney, Agent, or Firm* — Stein IP, LLC

(57) ABSTRACT

An inkjet recording apparatus of the present disclosure includes a recording head, a supply unit, a supply path, and a circulation path. The supply unit supplies liquid to the recording head. The liquid passes through the supply path to be supplied from the supply unit to the recording head. The liquid passes through the circulation path to return from the recording head to the supply unit. The supply path is provided with a supply coupling, and the circulation path is provided with a circulation coupling. Such part of the supply path as is located on an upstream side with respect to the supply coupling and such part of the circulation path as is located on a downstream side with respect to the circulation coupling are connected to each other by the bypass path which is switchable between a communicating state and a cut-off state.

11 Claims, 4 Drawing Sheets

INKJET RECORDING APPARATUS

INCORPORATION BY REFERENCE

This application is based upon and claims the benefit of priority from the corresponding Japanese Patent Application No. 2018-061458 filed on Mar. 28, 2018, the entire contents of which are incorporated herein by reference.

BACKGROUND

The present disclosure relates to an inkjet recording apparatus that includes a recording head which ejects ink onto a recording medium such as a paper sheet and a supply unit which supplies liquid to the recording head.

Inkjet recording apparatuses that eject ink and form an image with the ink are capable of forming a high-definition image and thus have been widely used as recording apparatuses such as facsimile machines, copiers, and printers.

A known inkjet recording apparatus includes a recording head, a supply unit which supplies ink (liquid) to the recording head, a supply path through which the ink passes to be supplied from the supply unit to the recording head, and a circulation path through which the ink passes to return to the supply unit from the recording head. The circulation path is provided for the purpose of bleeding the recording head of bubbles (returning bubbles from the recording head to the supply unit).

At the time of shipment of the inkjet recording apparatus, the supply unit is empty (filled with air), containing no ink, to prevent deterioration of ink, and the recording head is full of conservation liquid to reduce inclusion of bubbles. After receipt of the inkjet recording apparatus, the ink is filled in the supply unit, and the conservation liquid in the recording head is replaced with the ink.

SUMMARY

According to a first aspect of the present disclosure, an inkjet recording apparatus includes a recording head, a supply unit, a supply path, and a circulation path. The recording head ejects ink onto a recording medium. The supply unit supplies liquid to the recording head. The supply path connects the supply unit and the recording head to each other, and the liquid passes through the supply path to be supplied from the supply unit to the recording head. The circulation path connects the recording head and the supply unit to each other, and the liquid passes through the circulation path to return to the supply unit from the recording head. The supply path is provided with a supply coupling which is capable of disconnecting and connecting the supply path, and the circulation path is provided with a circulation coupling which is capable of disconnecting and connecting the circulation path. Such part of the supply path as is located on an upstream side with respect to the supply coupling and such part of the circulation path as is located on a downstream side with respect to the circulation coupling are connected to each other by a bypass path which is switchable between a communicating state and a cut-off state.

Still other objects of the present disclosure and specific advantages provided by the present disclosure will become further apparent from the following descriptions of embodiments.

DETAILED DESCRIPTION

Hereinafter, embodiments of the present disclosure will be described with reference to the accompanying drawings.

Figure 1:
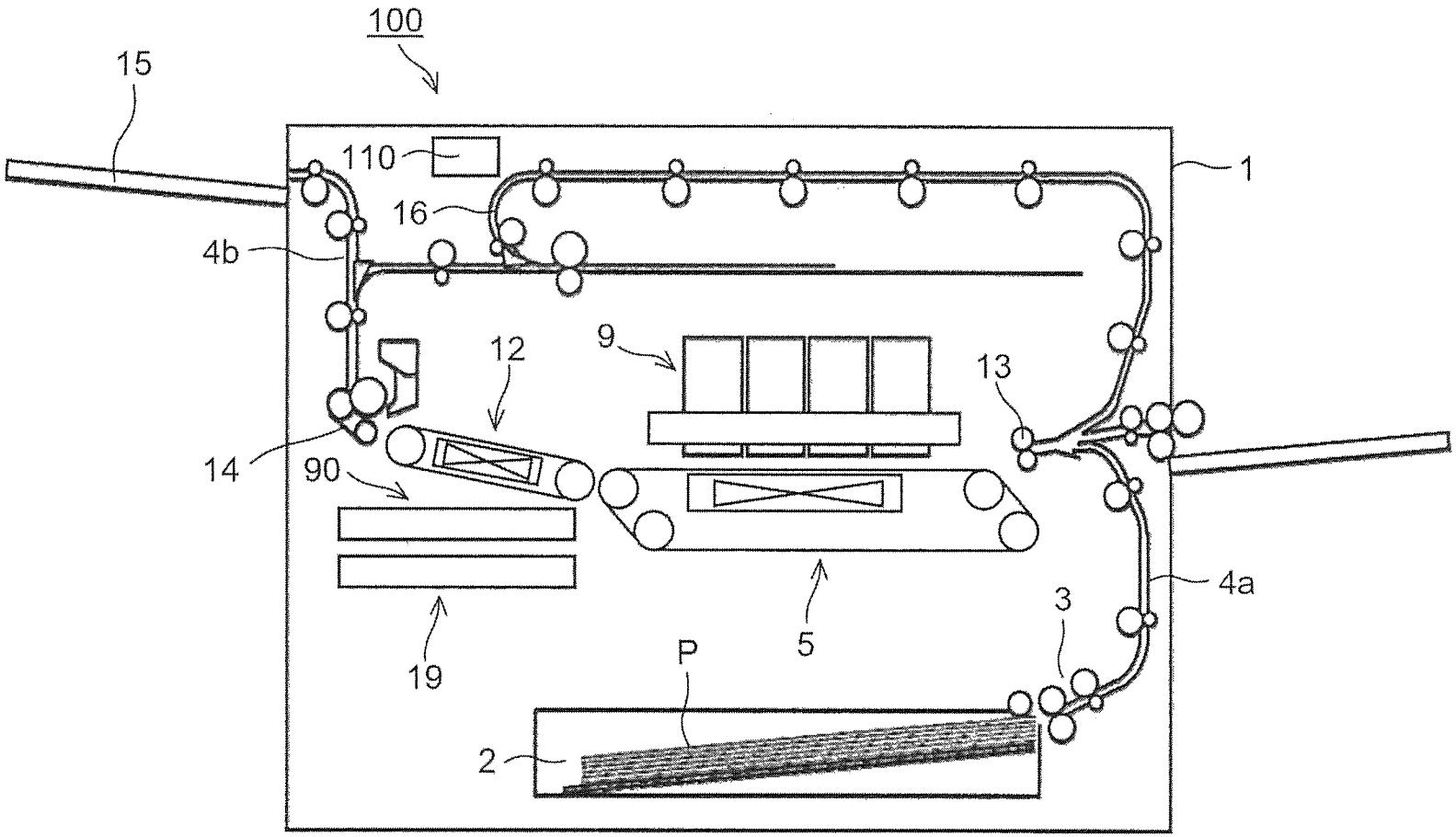
FIG. 1 is a diagram illustrating a structure of an inkjet recording apparatus according to an embodiment of the present disclosure.

With reference to FIG. 1 to FIG. 7, a description will be given of an inkjet recording apparatus 100 according to an embodiment of the present disclosure. As shown in FIG. 1, in the inkjet recording apparatus 100, in a lower part inside an apparatus main body 1, a sheet feeding cassette 2 is disposed as a sheet storage portion. The sheet feeding cassette 2 holds therein paper sheets P, a paper sheet P being an example of a recording medium. On the downstream side of the sheet feeding cassette 2 in a sheet conveyance direction, in other words, to the upper right of the sheet feeding cassette 2 in FIG. 1, a sheet feeding device 3 is disposed. By the sheet feeding device 3, the paper sheets P are fed out one by one separately toward the upper right side of the sheet feeding cassette 2 in FIG. 1.

The inkjet recording apparatus 100 includes a first sheet conveyance path 4*a*, which is disposed inside the inkjet recording apparatus 100. The first sheet conveyance path 4*a* is located, with respect to the sheet feeding cassette 2, on an upper right side, toward which a paper sheet is fed out from the sheet feeding cassette 2. A paper sheet P sent out from the sheet cassette 2 is conveyed through the first sheet conveyance path 4*a* upward along a side surface of the apparatus main body 1.

At a downstream end of the first sheet conveyance path 4*a* with respect to the sheet conveyance direction, a registration roller pair 13 is provided. On the downstream side of the registration roller pair 13 in the sheet conveyance direction, a first conveyance unit 5 and a recording portion 9 are disposed. The paper sheet P fed out from the sheet feeding cassette 2 passes through the first sheet conveyance path 4*a* to reach the registration roller pair 13. While correcting oblique feeding of the paper sheet P, the registration roller pair 13 sends out the paper sheet P toward the first conveyance unit 5, with timing coordinated with an ink ejecting operation performed by the recording portion 9.

On the downstream side of the first conveyance unit 5 with respect to the sheet conveyance direction (left side in FIG. 1), a second conveyance unit 12 is disposed. The paper sheet P on which an ink image has been recorded at the recording portion 9 is sent to the second conveyance unit 12, and while the paper sheet P passes through the second conveyance unit 12, ink that has been ejected onto a surface of the paper sheet P is dried.

On the downstream side of the second conveyance unit 12 with respect to the sheet conveyance direction, a de-curler portion 14 is disposed close to a left side surface of the apparatus main body 1. The paper sheet P on which the ink has been dried at the second conveyance unit 12 is sent to the de-curler portion 14, where a curl generated in the paper sheet P is corrected.

On the downstream side (upper side in FIG. 1) of the de-curler portion 14 with respect to the sheet conveyance direction, a second sheet conveyance path 4*b* is provided. The paper sheet P having passed through the de-curler portion 14 is, unless double-side recording is to be performed, sent through the second sheet conveyance path 4*b* to be discharged into a sheet discharge tray 15 provided outside a left side surface of the inkjet recording apparatus 100.

In an upper portion of the apparatus main body 1, a reverse conveyance path 16 for performing a double-side recording is disposed above the recording portion 9 and the second conveyance unit 12. In a case where double-sided recording is to be performed, the paper sheet P where recording with respect to a first surface thereof has been completed and that has passed through the second conveyance unit 12 and the de-curler portion 14 passes through the second sheet conveyance path 4*b* to be sent into the reverse conveyance path 16. The sheet P having been sent into the reverse conveyance path 16 then has its conveyance direction switched for recording to be performed on a second side thereof, and is sent rightward through the upper portion of the apparatus main body 1, then through the first sheet conveyance path 4*a* and the registration roller pair 13, and then back to the first conveyance unit 5, with the second side thereof facing upward.

Below the second conveyance unit 12, a wipe unit 19 and a cap unit 90 are disposed. For later-described purging, the wipe unit 19 horizontally moves to below the recording portion 9, where the wipe unit 19 wipes off ink extruded through ink ejection ports of the recording head, and collects the wiped-off ink. For capping an ink ejection surface of the recording head, the cap unit 90 horizontally moves to below the recording portion 9, and then the cap unit 90 further moves upward to be attached to a lower surface of the recording head.

Figure 2:
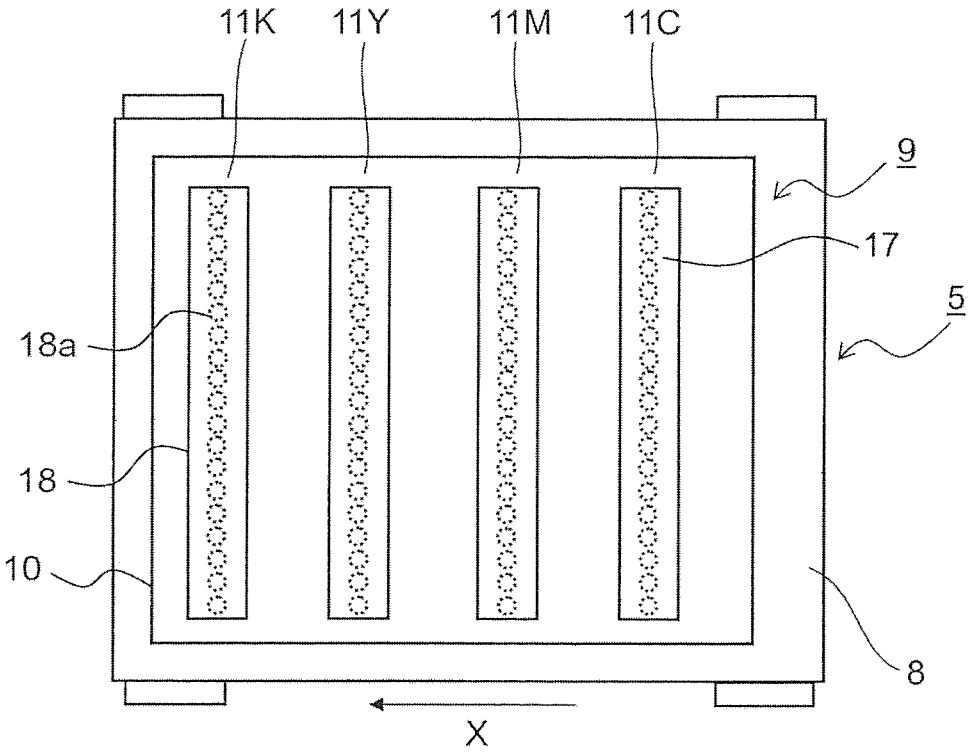
FIG. 2 is a diagram illustrating, as seen from above, a first conveyance unit and a recording portion of the inkjet recording apparatus illustrated in FIG. 1.

As shown in FIG. 2, the recording portion 9 includes a head housing 10, and line heads 11C, 11M, 11Y, and 11K, which are held in the head housing 10. These line heads 11C to 11K are supported at a height such that a predetermined gap (of, for example, 1 mm) is formed with respect to a conveyance surface of a first conveyance belt 8 of the first conveyance unit 5, and the line heads 11C to 11K are each constituted of one or more recording heads 17 (here, one recording head 17) extending along a sheet width direction (up-down direction in FIG. 2), which is perpendicular to the sheet conveyance direction (arrow X direction).

Figure 3:
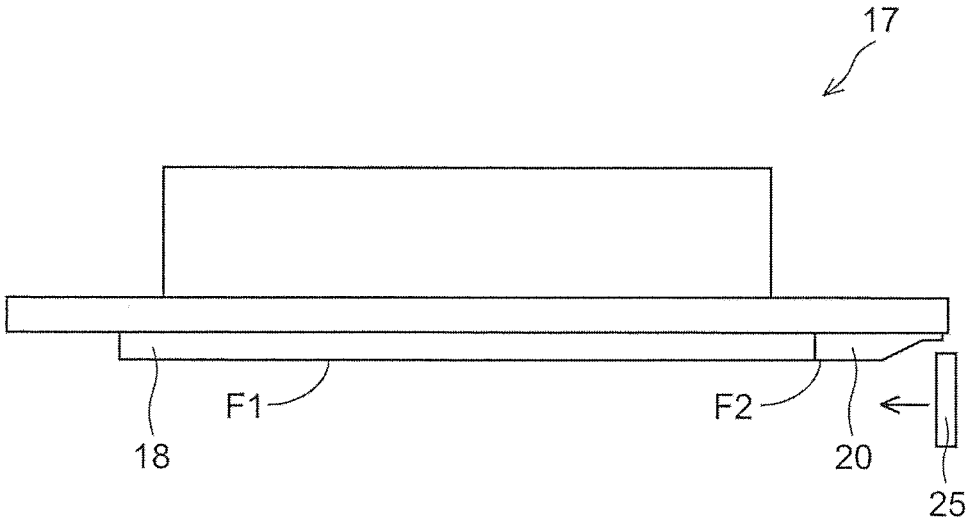
FIG. 3 is a diagram illustrating a recording head constituting a line head of the recording portion.
Figure 4:
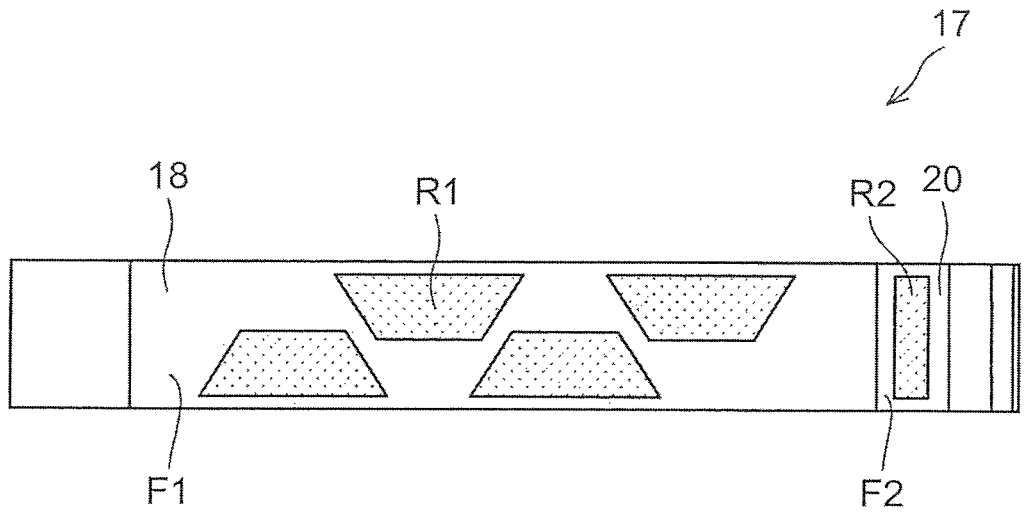
FIG. 4 is a diagram illustrating the recording head as seen from the side of an ink ejection surface.

As illustrated in FIG. 3 and FIG. 4, on an ink ejection surface F1 of a head portion 18 of the recording head 17, there is provided an ink ejection region R1 where a large number of ink ejection ports 18*a* (see FIG. 2) are arranged.

Recording heads 17, each constituting one of the line heads 11C to 11K, are each supplied with ink of one of four colors (cyan, magenta, yellow, and black) that corresponds to a color of the each of the line heads 11C to 11K.

Based on a control signal from the control portion 110 (see FIG. 1), each of the recording heads 17, in accordance with image data received from an external computer, ejects ink through the ink ejection ports 18*a* toward the paper sheet P, which is conveyed while being sucked and held on the conveyance surface of the first conveyance belt 8. Consequently, on the paper sheet P held on the first conveyance belt 8, ink images of the four colors of cyan, magenta, yellow, and black are superimposed on each other to form a color image.

The recording heads 17 are each provided with a cleaning liquid supply member 20 which supplies a cleaning liquid. The cleaning liquid supply member 20 is disposed adjacent to the upstream side (right side in FIG. 3) with respect to the head portion 18 in a wiping direction of a wiper 25. The cleaning liquid supply member 20 has a cleaning liquid supply surface F2 which includes a cleaning liquid supply region R2 where there are arranged a large number of cleaning liquid supply ports through which the cleaning liquid is supplied.

Figure 5:
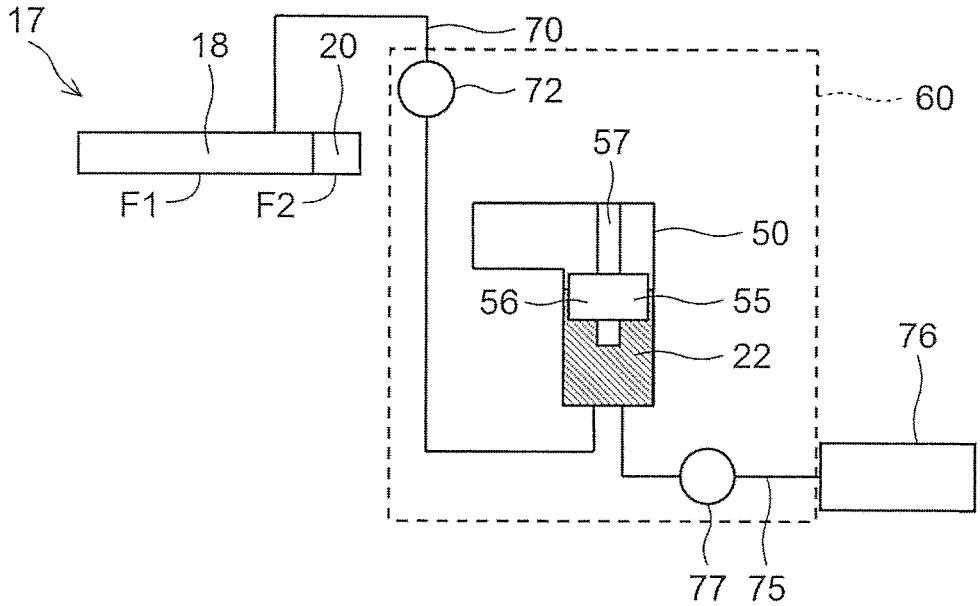
FIG. 5 is a diagram illustrating a configuration around a supply unit and a recording head in the inkjet recording apparatus according to the embodiment of the present disclosure.

As shown in FIG. 5, to each of the recording heads 17, there is connected a downstream end of a corresponding one of ink supply tubes 70 through each of which an ink 22 of a corresponding color flows. Upstream ends of the ink supply tubes 70 are each connected to a corresponding one of sub ink tanks (liquid tanks) 50 which each store the ink 22 of a corresponding color to be supplied to the recording heads 17. The ink supply tubes 70 are each provided with one of supply pumps (liquid feeding pumps) 72 for pumping up the ink 22 from the sub ink tanks 50 to be fed to the recording heads 17. The supply pumps 72, the sub ink tanks 50, later-described upstream-side tubes 70*a* of the ink supply tubes 70, and besides, air bleeding tubes 73, ink replenishment tubes 75, which will be described later, etc. constitute a supply unit 60 which supplies the ink (liquid) 22 to the recording heads 17. In the figure, the ink 22 is illustrated with hatching for easier understanding. The ink supply tubes 70, the sub ink tanks 50, the supply pumps 72, and besides, the ink replenishment tubes 75, ink packs 76, and replenishment pumps 77, which will be described later, are all provided one with respect to each of the recording heads 17, but, for simple illustration, just one set of them is illustrated in the figure.

To each of the sub ink tanks 50, there is connected a downstream end of a corresponding one of the ink replenishment tubes (replenishment paths) 75 through each of which the ink 22 of a corresponding color passes. Upstream ends of the ink replenishment tubes 75 are each connected to a corresponding one of the ink packs (replenishment container) 76 which each store the ink 22 to be replenished to a corresponding one of the sub ink tanks 50. The ink replenishment tubes 75 are provided with replenishment pumps 77 for pumping up the ink 22 from each of the ink packs 76 to send the ink to a corresponding one of the sub ink tanks 50. The supply pumps 72 and the replenishment pumps 77 may each be, for example, a tube pump, a syringe pump, a diaphragm pump, or the like.

The ink packs 76 are each a container made of an aluminum sheet, and an inside thereof is filled with the ink 22 which is degassed ink. When the ink 22 is supplied from the ink pack 76 to the recording head 17, as the ink 22 is gradually discharged from inside the ink pack 76, the external shape of the ink pack 76 is gradually smashed from a swelled state into a flat state.

The sub ink tanks 50 are each provided with a detection sensor 55 for detecting a liquid surface (upper surface) of the ink 22. When the detection sensor 55 detects absence of liquid (or a fall of liquid surface), a predetermined amount of the ink 22 is replenished, by the replenishment pump 77, from the ink pack 76 to the sub ink tank 50.

The cleaning liquid supply member 20 is so configured as to be supplied with the cleaning liquid by a liquid feeding mechanism similar to that for the head portion 18. Specifically, to the cleaning liquid supply member 20, the cleaning liquid is supplied by using a supply pump from a main cleaning liquid tank to a sub cleaning liquid tank (of which neither is illustrated).

In the inkjet recording apparatus 100, in order to clean the ink ejection surface F1 of the recording head 17, at a start of printing after a long-term shutdown and during an interim between printing operations, purging is executed to extrude the ink 22 having an increased viscosity from the ink ejection ports 18*a* of the head portion 18, and also the cleaning liquid is supplied through the cleaning liquid supply ports (not shown) of the cleaning liquid supply member 20. Then, the wiper 25 (see FIG. 3) of the wipe unit 19 wipes the cleaning liquid supply surface F2 and the ink ejection surface F1. At this time, waste ink and waste cleaning liquid are wiped off by the wiper 25 and collected in a collection tray (not shown) provided in the wipe unit 19, and then sent via a waste ink tube into a waste ink tank (not shown) to be stored therein. This recovery operation for the recording head 17 is executed by controlling, based on a control signal from a control portion 110 (see FIG. 1), operations of the recording head 17, the wipe unit 19, the supply pump 72, etc.

Next, a description will be given of a structure around the sub ink tank 50.

As shown in FIG. 5, the detection sensor 55 includes a float 56 which is disposed inside the sub ink tank 50 and moves up and down within a predetermined range in accordance with the amount of the ink in the sub ink tank 50, and a sensor main body 57 which is rod-shaped and detects a liquid surface of the ink 22 when the float 56 moves in the up-down direction. The float 56 is formed in a cylindrical shape and provided with a magnet (not shown), which is disposed inside the float 56. The sensor main body 57 is inserted through a center portion of the float 56. Inside the sensor main body 57, there is provided a lead switch (not shown) which operates when the magnet (not shown) moves in an up-down direction. Here, when the liquid surface of the ink 22 falls to a predetermined position, the float 56 falls to a lower limit position. Consequently, the lead switch (not shown) is activated, and a replenishment signal is transmitted from the sensor main body 57 to the control portion 110, which performs control such that a predetermined amount of ink 22 is replenished from the ink pack 76 to the sub ink tank 50. As a result, the liquid surface of the ink 22 rises to a predetermined position, and the float 56 rises to an upper limit position.

The sub ink tank 50 is disposed at a height such that the liquid surface of the ink 22 is located a little below the recording head 17. Thus, a negative pressure is applied to the ink 22 in the recording head 17, and, at a constant position (at a lower end of each of the ink ejection ports 18*a* of the recording head 17), a meniscus of the ink 22 is so formed as to be curved toward an inside (upside) of the recording head 17.

Figure 6:
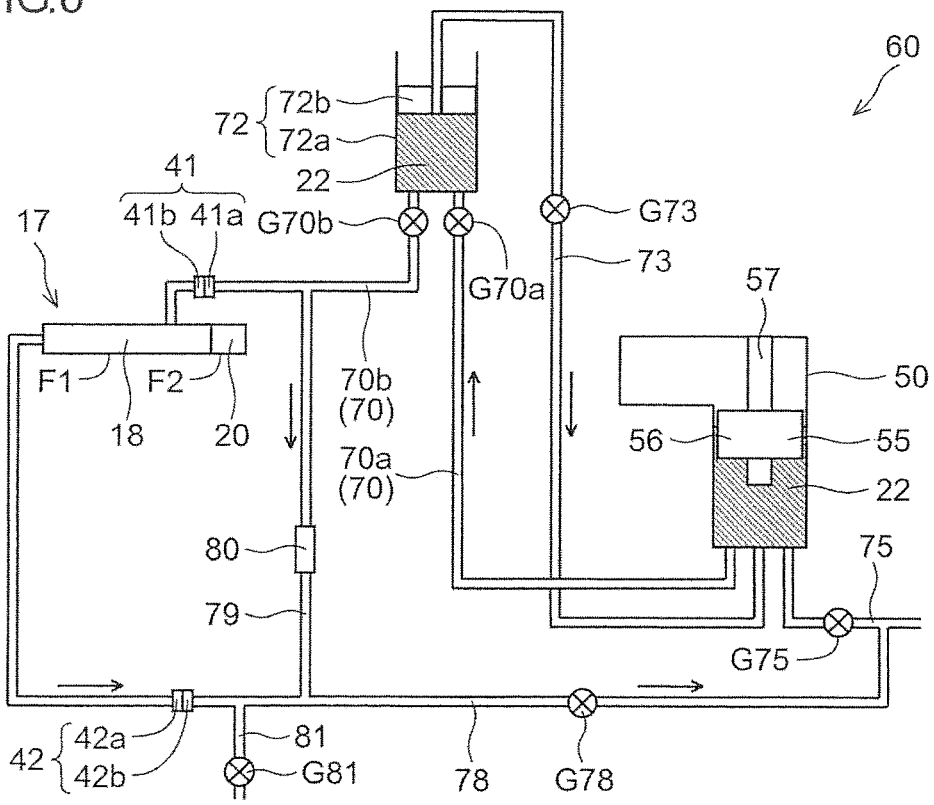
FIG. 6 is a diagram illustrating a configuration around the supply unit and the recording head in the inkjet recording apparatus according to the embodiment of the present disclosure.

As illustrated in FIG. 6, the supply pump 72 includes a cylinder 72*a* having a shape with a cavity, and a piston portion 72*b* which is disposed in the cavity of the cylinder 72*a* and caused to move along a longitudinal direction of the cylinder 72*a* (up-down direction) by a drive mechanism (not shown).

The ink supply tube 70 is composed of an upstream-side tube (liquid feeding path) 70*a* and a downstream-side tube (supply path) 70*b*, and a bottom of the cylinder 72*a* has connected thereto a downstream end of the upstream-side tube 70*a* and an upstream end of the downstream-side tube 70*b*, the upstream-side tube 70*a* being connected to the sub ink tank 50, the downstream-side tube 70*b* being connected to the recording head 17. That is, the downstream-side tube 70*b* connects the recording head 17 and the supply unit 60 to each other, and the ink 22 passes through the downstream-side tube 70*b* to be supplied from the supply unit 60 to the recording head 17.

To the piston portion 72*b*, there is connected an upstream end of the air bleeding tube 73 which allows air from the supply pump 72 to pass therethrough. The air bleeding tube 73 is provided for the purpose of bleeding the supply pump 72 of air in a case where air has gradually entered the supply pump 72 for some reason (for example, a foreign object caught between an inner side surface of the cylinder 72*a* and the piston portion 72*b*). The air having entered the supply pump 72 stays at a boundary between the piston portion 72*b* and the liquid surface (the upper surface) of the ink 22. Thus, by moving the piston portion 72*b* downward, it is possible to cause the air inside the supply pump 72 to move via the air bleeding tube 73 to the sub ink tank 50. This air bleeding operation is performed regularly (for example, about once a week).

The ink replenishment tube 75, the upstream-side tube 70*a*, the downstream-side tube 70*b*, and the air bleeding tube 73 are respectively provided with solenoid-operated valves G75, G70*a*, G70*b*, and G73, each for opening and closing an ink flow path (or an air flow path). The opening-closing operation of each of solenoid-operated valves G75, G70*a*, G70*b*, and G73 is performed by the control portion 110.

Here, in this embodiment, the recording head 17 has connected thereto an upstream end of a circulation tube (circulating path) 78 through which the ink 22 passes to return from the recording head 17 to the supply unit 60. The circulation tube 78 is provided for the purpose of returning the ink 22 from the recording head 17 to the supply unit 60 when bleeding the recording head 17 of air. A downstream end of the circulation tube 78 is connected to the ink replenishment tube 75, and here, the downstream end of the circulation tube 78 is connected to such part of the ink replenishment tube 75 as is located downstream of the replenishment pump 77 (see FIG. 5) but upstream of solenoid-operated valve G75.

Figure 7:
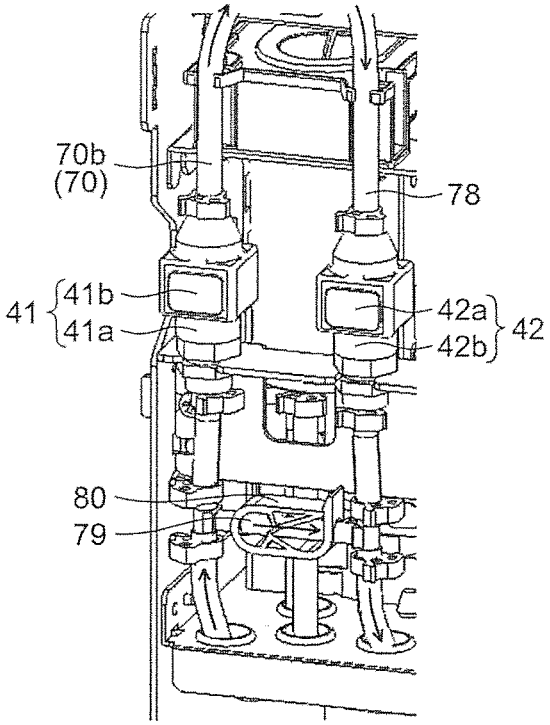
FIG. 7 is a diagram illustrating a structure around a supply coupling and a circulation coupling in the inkjet recording apparatus according to the embodiment of the present disclosure.

As shown in FIG. 6 and FIG. 7, at a predetermined position in the downstream-side tube 70*b*, through which the ink 22 passes to be supplied from the supply unit 60 to the recording head 17, a supply coupling 41 is provided which is capable of disconnecting and connecting the downstream-side tube 70*b*. The supply coupling 41 is composed of a male portion 41*a*, which is disposed on the upstream side, and a female portion 41*b*, which is disposed on the downstream side and is attachable and detachable with respect to the male portion 41*a*. The male portion 41*a* and the female portion 41*b* each incorporate a valve member (not shown) which keeps the ink flow path open when the male portion 41*a* and the female portion 41*b* are connected to each other, and which keeps the ink flow path closed when the male portion 41*a* and the female portion 41*b* are disconnected from each other.

At a predetermined position in circulation tube 78, through which the ink 22 passes to return from the recording head 17 to the supply unit 60, a circulation coupling 42 is provided which is capable of disconnecting and connecting the circulation tube 78. The circulation coupling 42 is composed of a female portion 42*a*, which is disposed on the upstream side, and a male portion 42*b*, which is disposed on the downstream side and is attachable and detachable with respect to the female portion 42*a*. The female portion 42*a* and the male portion 42*b* each incorporate a valve member (not shown) which keeps the ink flow path open when the female portion 42*a* and the male portion 42*b* are connected to each other, and which keeps the ink flow path closed when the female portion 42*a* and the male portion 42*b* are disconnected from each other.

Such part of the downstream-side tube 70*b* as is located on the upstream side with respect to the supply coupling 41 and such part of the circulation tube 78 as is located on the downstream side with respect to the circulation coupling 42 are connected to each other via a bypass tube (bypass path) 79. The bypass tube 79 is switchable between a communicating state and a cut-off state. In this embodiment, the bypass tube 79 is provided with a clamp (switching member) 80, which opens and closes the ink flow path. Here, instead of providing the clamp 80, a commercially available clip (not shown) or the like may be used to switch the bypass tube 79 between the communicating state and the cut-off state.

To the circulation tube 78, as shown in FIG. 6, there is connected an upstream end of a discharge tube (discharge path) 81 for the purpose of discharging the conservation liquid having been filled in the recording head 17 in the initial state (at the time of shipment). Here, the discharge tube 81 is connected to such part of the circulation tube 78 as is located on the downstream side of the circulation coupling 42. The discharge tube 81 is provided with a solenoid-operated valve G81 which opens and closes a conservation-liquid flow path. A downstream end of the discharge tube 81 is connected to an exhaust conservation liquid tank (not shown). The circulation tube 78 is provided with a solenoid-operated valve G78 which opens/closes the ink flow path. Here, the solenoid-operated valve G78 is provided in the circulation tube 78 to be positioned on the downstream side of a connection portion between the discharge tube 81 and the circulation tube 78. The opening-closing operation of each of the solenoid-operated valves G81 and G78 is performed by the control portion 110.

In the inkjet recording apparatus 100, in a case where the ink 22 is replenished from the ink pack 76 to the sub ink tank 50, the solenoid-operated valve G75 remains open, and the solenoid-operated valve G78 remains closed. In a case where the ink 22 is supplied from the sub ink tank 50 to the supply pump 72, the solenoid-operated valves G75 and G73 remain closed and the solenoid-operated valve G70*a* remains open. In a case where the ink 22 is supplied toward the recording head 17 by using the supply pump 72, the solenoid-operated valves G70*a* and G73 remain closed, and the solenoid-operated valve G70*b* remains open. During the above-described air bleeding operation, the solenoid-operated valves G70*a*, and G70*b* are kept closed, and the solenoid-operated valve G73 is kept open.

At the time of shipment of the inkjet recording apparatus 100, the supply unit 60 is empty (filled with air) for the purpose of preventing deterioration of the ink 22, and the recording head 17 is in the state of being fitted with the conservation liquid (not shown). As for the supply coupling 41, the male portion 41*a* and the female portion 41*b* are in the state of being disconnected from each other, and as for the circulation coupling 42, the female portion 42*a* and the male portion 42*b* are in the state of being disconnected from each other.

After receipt of the inkjet recording apparatus 100, the ink pack 76 is attached to the upstream end of the ink replenishment tube 75, and the ink 22 is filled in the supply unit 60. At this time, the ink 22 is circulated from the downstream-side tube 70*b*, via the bypass tube 79, to the circulation tube 78. That is, the ink 22 is filled in the supply unit 60 without passing through the recording head 17.

Then, the male portion 41*a* and the female portion 41*b* of the supply coupling 41 are connected to each other to allow passage through the downstream-side tube 70*b*, and the female portion 42*a* and the male portion 42*b* of the circulation coupling 42 are connected to each other to allow passage through the circulation tube 78. Further, the bypass tube 79 is brought into the cut-off state by the clamp 80, and the solenoid-operated valve G78 is closed. Then, the ink 22 is supplied to the recording head 17 by the supply pump 72, to thereby replace the conservation liquid in the recording head 17 with the ink 22. The conservation liquid in the recording head 17 is discharged via the discharge tube 81 into the exhaust conservation liquid tank (not shown). Then, the solenoid-operated valve G81 is closed and the solenoid-operated valve G78 is opened.

In this embodiment, as described above, such part of the downstream-side tube 70*b* as is located on the upstream side with respect to the supply coupling 41 and such part of the circulation tube 78 as is located on the downstream side with respect to the circulation coupling 42 are connected to each other via the bypass tube 79, which is switchable between a communicating state and a cut-off state. Consequently, after receipt of the inkjet recording apparatus 100, it is possible to circulate the ink 22 from the downstream-side tube 70*b*, via the bypass tube 79, into the circulation tube 78. That is, without passing through the recording head 17, the ink 22 can be filled into the supply unit 60. Then, the male portion 41*a* and the female portion 41*b* of the supply coupling 41 are connected to each other to allow passage through the downstream-side tube 70*b*, the female portion 42*a* and the male portion 42*b* of the circulation coupling 42 are connected to each other to allow passage through the circulation tube 78, and the conservation liquid in the recording head 17 is replaced with the ink 22, whereby it is possible to reduce inclusion of bubbles (generation of bubbles) in the ink 22 in the recording head 17.

The provision of the bypass tube 79 to connect the downstream-side tube 70*b* and the circulation tube 78 to each other eliminates need of connecting the supply coupling 41 and the circulation coupling 42 to each other to achieve a circulation structure on the side of the supply unit 60. Consequently, in replacing the conservation liquid in the recording head 17 with the ink 22 after the ink 22 is filled in the supply unit 60, there is no need of disconnecting the supply coupling 41 and the circulation coupling 42, and thus leakage of the ink 22 never occurs through the connection portion between the supply coupling 41 and the circulation coupling 42. Thus, it is possible to reduce occurrence of soiling of the inside of the inkjet recording apparatus 100 with the ink 22.

As described above, the downstream-side tube 70*b* connects the supply pump 72 and the recording head 17 to each other, and the circulation tube 78 connects the recording head 17 and the ink replenishment tube 75 to each other. Consequently, it is possible to easily supply the ink 22 from the supply unit 60 to the recording head 17 via the downstream-side tube 70*b*, and to easily return the ink 22 from the recording head 17 to the supply unit 60 via the circulation tube 78.

As described above, the bypass tube 79 is provided with the clamp 80, which switches the bypass tube 79 between the communicating state and the cut-off state. Consequently, after receipt of the inkjet recording apparatus 100, by bringing the bypass tube 79 into the communicating state, it is possible to easily circulate the ink 22 from the downstream-side tube 70*b*, via the bypass tube 79, into the circulation tube 78. Further, after filling the supply unit 60 with the ink 22, by bringing the bypass tube 79 into the cut-off state, it is possible to easily replace the conservation liquid in the recording head 17 with the ink 22.

As described above, to the circulation tube 78, the discharge tube 81 is connected through which the conservation liquid discharged from the recording head 17 passes. Consequently, in replacing the conservation liquid in the recording head 17 with the ink 22, it is possible to easily reduce entry of the conservation liquid into the sub ink tank 50.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above-described embodiments have dealt with examples where the ink 22 is used as an example of liquid, but this is not meant to limit the present disclosure. The cleaning liquid may be used as the liquid that is supplied from the supply unit 60 to the recording head 17 and that is returned from the recording head 17 to the supply unit 60.

Further, in the above-described embodiments have dealt with examples where the discharge tube (discharge path) 81 is connected to the circulation tube (circulation path) 78, but this is not meant to limit the present disclosure; the discharge tube (discharge path) 81 may be unconnected to the circulation tube (circulation path) 78.

What is claimed is:

1. An inkjet recording apparatus comprising:

a recording head which ejects ink onto a recording medium;

a supply unit which supplies liquid to the recording head;

a supply path which connects the supply unit and the recording head to each other and through which the liquid passes to be supplied from the supply unit to the recording head; and a circulation path which connects the recording head and the supply unit to each other and through which the liquid passes to return from the recording head to the supply unit, wherein the supply path is provided with a supply coupling which is capable of disconnecting and connecting the supply path, the circulation path is provided with a circulation coupling which is capable of disconnecting and connecting the circulation path, and such part of the supply path as is located on an upstream side with respect to the supply coupling and such part of the circulation path as is located on a downstream side with respect to the circulation coupling are connected to each other by a bypass path which is switchable between a communicating state and a cut-off state.

2. The inkjet recording apparatus according to claim 1, wherein the supply unit includes a liquid tank which stores therein the liquid to be replenished from the replenishment container, a replenishment path which connects the replenishment container and the liquid tank to each other, a liquid feeding pump to which the liquid is supplied from the liquid tank and which feeds the liquid to the recording head, and a liquid feeding path which connects the liquid tank and the liquid feeding pump to each other, the supply path connects the liquid feeding pump and the recording head to each other, and the circulation path connects the recording head and the replenishment path to each other.

3. The inkjet recording apparatus according to claim 1, wherein the bypass path is provided with a switching member which switches the bypass path between the communicating state and the cut-off state.

4. The inkjet recording apparatus according to claim 1, wherein the liquid is ink.

5. The inkjet recording apparatus according to claim 1, wherein in a state where the supply path is disconnected by the supply coupling, a flow path of the supply path is closed, and in a state where the circulation path is disconnected by the circulation coupling, a flow path of the circulation path is closed.

6. An inkjet recording apparatus comprising, a recording head which ejects ink onto a recording medium;

a supply unit which supplies liquid to the recording head;

a supply path which connects the supply unit and the recording head to each other and through which the liquid passes to be supplied from the supply unit to the recording head; and a circulation path which connects the recording head and the supply unit to each other and through which the liquid passes to return from the recording head to the supply unit, wherein the supply path is provided with a supply coupling which is capable of disconnecting and connecting the supply path, the circulation path is provided with a circulation coupling which is capable of disconnecting and connecting the circulation path, such part of the supply path is located on an upstream side with respect to the supply coupling and such part of the circulation path as is located on a downstream side with respect to the circulation coup in are connected to each other by a bypass path which is switchable between a communication state and a cut-off state, to the circulation path, there is connected a discharge path through which liquid discharged from the recording head passes and the discharge path is connected to such part of the circulation path as is located on an upstream side of a position at which the circulation path and the bypass path are connected to each other.

7. The inkjet recording apparatus according to claim 6, wherein the discharge path is connected to such part of the circulation path as is located on a downstream side of the circulation coupling.

8. The inkjet recording apparatus according to claim 6, wherein in a state where the supply path is disconnected by the supply coupling, a flow path of the supply path is closed, and in a state where the circulation path is disconnected by the circulation coupling, a flow path of the circulation path is closed.

9. The inkjet recording apparatus according to claim 6, wherein the supply unit includes a liquid tank which stores therein the liquid to be replenished from the replenishment container, a replenishment path which connects the replenishment container and the liquid tank to each other, a liquid feeding pump to which the liquid is supplied from the liquid tank and which feeds the liquid to the recording head, and a liquid feeding path which connects the liquid tank and the liquid feeding pump to each other, the supply path connects the liquid feeding pump and the recording head to each other, and the circulation path connects the recording head and the replenishment path to each other.

10. The inkjet recording apparatus according to claim 6, wherein the bypass path is provided with a switching member which switches the bypass path between the communicating state and the cutoff state.

11. The inkjet recording apparatus according to claim 6, wherein the liquid supplied by the supply unit is ink.

* * * * *